United States Patent [19]

Mims et al.

[11] 4,033,520

[45] July 5, 1977

[54] NOISE REDUCING TEXTILE TRAVERSE ROD

[75] Inventors: Herman D. Mims; John A. Willes; Baylor D. Gibson, all of Charlotte, N.C.

[73] Assignee: Celanese Corporation, Charlotte, N.C.

[22] Filed: July 28, 1975

[21] Appl. No.: 599,509

[52] U.S. Cl. ..... 242/43 R; 242/18 R; 242/157 R

[51] Int. Cl.[2] ..... B65H 54/28; B65H 57/00

[58] Field of Search ..... 242/157 R, 43 R, 18 R

[56] References Cited

UNITED STATES PATENTS

| | | | |
|---|---|---|---|
| 1,348,291 | 8/1920 | Marcroft | 242/43 R |
| 1,588,042 | 6/1926 | Morrell | 242/18 R |
| 2,650,036 | 8/1953 | Berkepeis | 242/43 R |
| 2,738,137 | 3/1956 | Breen | 242/43 R X |

*Primary Examiner*—Stanley N. Gilreath
*Attorney, Agent, or Firm*—H. M. Adrian, Jr.

[57] ABSTRACT

A textile traverse rod guide device particularly suited for the guiding of winding of yarns onto packages is described wherein the traverse guide substantially reduces the noise level of winding machine when in operation. The traverse guide is capable of reducing the noise level on the order of 5 to 8 decibels compared to previously used devices while at the same time providing better package build. The noted traverse guide is fabricated as a single piece from engineering plastics and operates utilizing torque-tension principles rather than mechanical guidance and swivel means.

8 Claims, 2 Drawing Figures

NOISE REDUCING TEXTILE TRAVERSE ROD

BACKGROUND OF THE INVENTION

Figure 1:
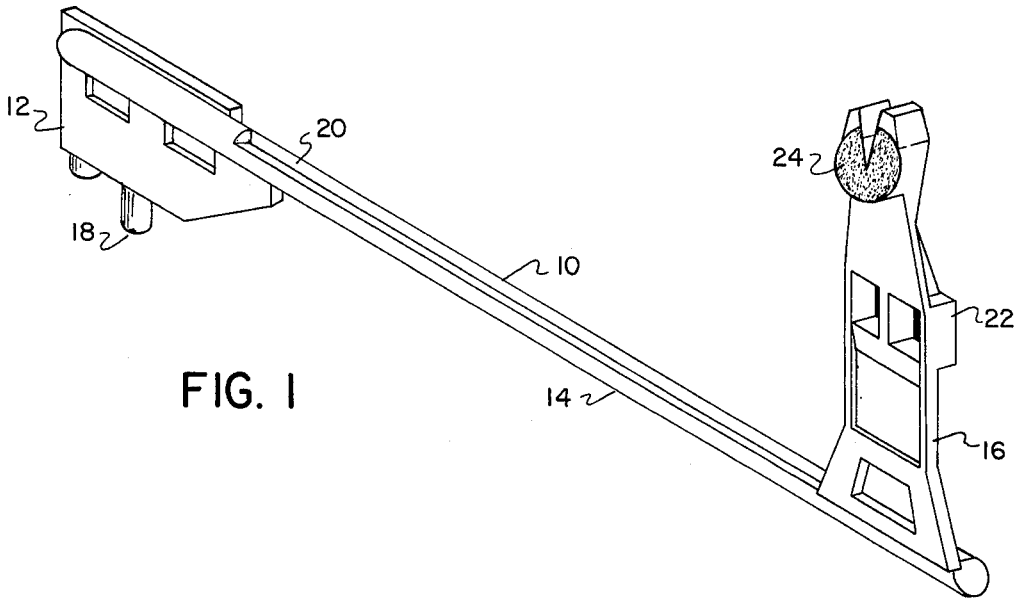

One of the most extensively used textile apparatus is the textile winder and/or coner. These winders are utilized to rewind yarn from larger packages into smaller packages which are used directly in knitting, weaving and other fabric making operations. Typical of such winders are the Leesona Model 50 winder and winders made by Universal Winding Machine Company. It has been estimated that many more than 1,000,000 winders have been put into use in the United States alone and that at least 800,000 Lessona Model 50 winders are still in operation.

Recent Federal Noise Abatement requirements (OSHA) specify that textile machinery of this type be operated at a noise level of 90 or less decibels. The winders described are incapable of operating these requirements. The actual noise level of the winders is dependent upon a number of factors including the number and density of winders at a given location and the acoustics of the room. A plurality of winders generally developed noise levels in the mid-nineties or higher, with large numbers of machines creating the higher noise levels. In the normal textile operation, numerous machines are operated at the same time.

It has been discovered that one of the greatest single sources of noise in such winders is the traverse rod guide mechanism which reciprocates across the face of the package being wound. The prior art traverse rod comprises three basic parts, namely the cam engagement pivot, the guide shaft and the thread guide through which the thread or yarn passes onto the package. All of these parts have previously been made of steel or other hardened metal utilizing a thread guide button which is usually made of ceramic or specially treated metal. The cam guide pivot is joined in swivel relationship to the guide shaft. The thread guide has a hook engagement means which engages a follower plate which guides the thread guide in a curvilinear path as it reciprocates to thereby parallel the desired cone-shaped package build as the machine operates. Attempts have previously been made to substitute plastics for certain of the metal parts to thereby reduce the mass weight, but such attempts have failed to accomplish the desired objectives.

It is an object of the present invention to provide a means for reducing the noise level of such winding machines so that they can meet Federal Noise Abatement requirements.

It is another object of the present invention to provide a simplified traverse guide rod which is unitarily constructed.

It is a further object of the present invention to provide a traverse guide mechanism which operates on a torsional-tension principle and thereby provide an improved package build.

It is yet a further object of the present invention to provide an inexpensive replacement guide mechanism by which existing machines can be modified to meet Federal noise reduction standards.

These and other objects of the present invention will become apparent to those skilled in the art from a description of the invention which follows.

THE INVENTION

In accordance with the invention, there is provided a textile traverse rod guide for a textile winder which provides a reduced noise output comprising a unitarily fabricated traverse rod guide constructed of an engineering plastic, said traverse rod guide having cam engagement means, elongated shaft means and thread guide means, said cam engagements means connecting said thread guide means through said shaft means as a single fabricated structure, said cam engaging means and thread means being longitudinally aligned so as to effect a torsional tension through said shaft means when said traverse guide rod is positioned in a textile winder.

The noted traverse guide rod is not only composed of a single unitary fabricated structure, thus reducing the previous numerous component parts of previous traverse rod guides, but also the present traverse rod guide weighs only about one-third of the weight of previous rods. This weight reduction, coupled with the different means of operation, i.e. the torsional tension principle, reduces the noise level 5 to 8 decibels when in operation on a winder. The torsional tension utilized in the present rod enables the thread guide means to exert continuous predesignated pressure against the follower plate of the winder, thereby eliminating the previous hook means, which is a source of rattle and noise. The elimination of this rattle not only results in a noise reduction but much greater precision in package build, thereby improving the resulting yarn packages.

DETAILS OF THE INVENTION

Figure 2:
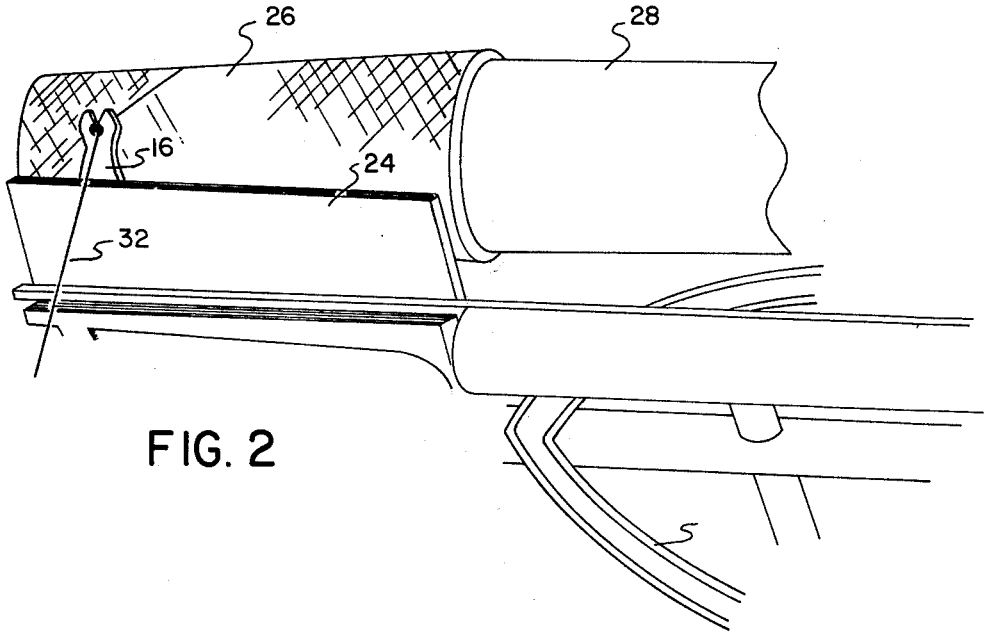

The invention will be described more fully by reference to the drawings wherein:

FIG. 1 is a perspective view of the traverse rod guide means of the present invention, and FIG. 2 is a partial elevational view of a winder with the traverse rod guide in position.

Traverse guide rod 10 is composed of three basic elements referred to as cam engagement means 12, shaft means 14 and thread guide means 16. Cam engagement means 12 additionally has associated therewith cam follower pin 18 which preferably is a metal peg embedded in cam engagement means 12. Pin 18 supports a cam follower roller that is engaged in traverse cam groove 30. The cam follower roller can be made of metal or plastic.

Shaft means 14 is an elongated rod of sufficient length to connect cam engagement means 12 with thread guide means 16 at a spaced distance equal to that required for the given winding machine to thereby traverse thread guide means 16 across face of package 26 being wound on winder 28 while engaging cam engagement means 12 with cam groove 30 which causes reciprocal movement of the traverse rod guide 10, thereby causing thread guide means 16 to move longitudinally along the package 26 as thread or yarn is wound. Shaft means 14 preferably has longitudinal grooves 20 which are engineered to provide the desired torsional-tension when traverse rod guide 10 is positioned within winder 28.

Thread guide means 16 has backplate 22 which rests against follower plate 34 of the winding apparatus. Backplate 22 exerts tensional pressure against follower plate 34 created by the torsional action passed through shaft means 14 of the traverse guide means to thereby maintain thread guide means 16 firmly positioned against follower plate 34 during the reciprocal movement of the traverse rod guide. Follower plate 34 is normally positioned in skewed relationship to the axis of the winder so as to provide for a conical package build. Thus, thread guide means 16 does not normally follow a path parallel to the axis of the winder but rather parallel to the surface of the conical package. For winding parallel packages, the backplate would be parallel to the axis of traverse and the thread guide means would still be in torsion against the backplate.

The torsional tension of backplate 22 of thread guide means 16 is engineered to provide the required steady tension. The tension exerted is only that which is sufficient to cause the thread guide to follow the follower plate in the skewed path. This tension is created by the alignment of cam engagement means 12 with thread guide means 16. Longitudinal grooves 20 on shaft means 14 control the degree of tension and aid in controlling tension uniformity.

Thread guide means 16 additionally has guide button insert 24 through which the yarn 32 is strung. Guide button insert can rest directly against the yarn package as it is traversed back and forth in its reciprocal movement. Such guide button is preferably composed of ceramic or specially hardened metal which is resistant to the wear of thread or yarn as it is passed through the guide.

Traverse rod guide is composed of an engineering plastic such as nylon, polyester, polycarbonate, polyacetyl, polyoxymethylene and the like. The nylons are, of course, polyamides of which polyhexamethylene adipamide and polycaprolactam are the most frequent examples although copolyamides such as nylon 6, 8, nylon 6, 12 and the like could be used. Polyesters include polyethylene terephthalate and polybutylene terephthalate as typical examples. Polyacetyl is sold under the trademark of Celcon and polyoxymethylene is sold under the trademark of Delrin, both of which are preferred engineering plastics.

The noted engineering plastics have been found to exhibit greater impact resistance and a longer wear life when fillers are used. Mineral fillers are particularly preferred, such as silica, calcium carbonate, glass and the like, which fillers are added to the polymer in a finely divided state in amounts of 10 to 50 percent prior to molding.

While the invention has been more fully described by reference to certain preferred embodiments noted herein, it will be apparent to those skilled in the art that various changes can be made in the present invention without departing from the spirit or teaching of the present invention. Consequently, the invention is not intended to be limited except by the appended claims.

What is claimed is:

1. A textile traverse rod guide for a textile winder for reduced noise output comprising a unitarily fabricated traverse rod guide having cam engagement means, elongated shaft means and thread guide means, said cam engagement means connecting said thread guide means through said shaft means as a single fabricated structure, said structure being of an engineering plastic and wherein said cam engagement means and thread guide means are in fixed relationship to each other as they are joined by said shaft means, said shaft means being flexible about its axis such that when said cam engagement means and said thread guide means are twisted about said flexible shaft means, a torsional tension is created to return said cam engagement means and thread guide means to their fixed relationship.

2. The apparatus of claim 1 wherein the engineering plastic contains 10 to 50 percent filler.

3. The apparatus of claim 2 wherein the filler is a mineral such as glass.

4. The apparatus of claim 1 wherein the shaft means is longitudinally grooved.

5. The apparatus of claim 1 wherein the thread guide means has a ceramic button guide insert.

6. The apparatus of claim 1 wherein the cam engagement means has a metal cam follower.

7. The apparatus of claim 2 wherein the filler is a mineral such as silica.

8. The apparatus of claim 2 wherein the filler is a mineral such as calcium carbonate.

* * * * *

UNITED STATES PATENT OFFICE

CERTIFICATE OF CORRECTION

Patent No. 4,033,520 Dated July 5, 1977

Inventor(s) Herman D. Mims et al

It is certified that error appears in the above-identified patent and that said Letters Patent are hereby corrected as shown below:

Column 1, line 20, after "incapable of operating", -- within -- should be inserted.

Column 2, line 9, "engagements" should read -- engagement --.

Column 2, line 12, after "and thread", -- guide -- should be inserted.

Claim 1, line 1, "a textile winder for" should read -- a textile winder of --.

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*